US006725701B2

(12) United States Patent
Nakayama et al.

(10) Patent No.: US 6,725,701 B2
(45) Date of Patent: Apr. 27, 2004

(54) CLUSTER TYPE MULTISTAGE ROLLING MILL

(75) Inventors: Toru Nakayama, Hitachi (JP); Michimasa Takagi, Hitachi (JP); Takashi Norikura, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/943,356

(22) Filed: Aug. 31, 2001

(65) Prior Publication Data

US 2002/0152787 A1 Oct. 24, 2002

(30) Foreign Application Priority Data

Feb. 20, 2001 (JP) ..... 2001-043165

(51) Int. Cl.[7] ..... B21B 31/07
(52) U.S. Cl. ..... 72/237; 72/242.4
(58) Field of Search ..... 72/237, 238, 242.2, 72/242.4, 243.4, 245, 248

(56) References Cited

U.S. PATENT DOCUMENTS 6,260,397 B1 * 7/2001 Zheng et al. ..... 72/237

FOREIGN PATENT DOCUMENTS

| | | | | |
|---|---|---|---|---|
| CN | PCT/CN97/00091 | * | 3/1999 | ..... B21B/13/14 |
| EP | 0998992 | | 5/2000 | |
| JP | 5024902 | | 8/1975 | |

OTHER PUBLICATIONS

"Symposium on Steel Production Technology, 1993" A Collection of Technical Papers, pp. 379–389.

* cited by examiner

*Primary Examiner*—Allen Ostrager
*Assistant Examiner*—John S. Goetz
(74) *Attorney, Agent, or Firm*—Crowell & Moring LLP

(57) ABSTRACT

In a cluster type split housing type rolling mill, the plate thickness control capability is improved by maintaining maximum mill rigidity. An upper inner housing supporting an upper group of rolls is supported at two points in a rolling pass direction at upper outer housing sections. A lower inner housing supporting a lower group of rolls is supported at a single point in the rolling pass direction at lower outer housing sections. The upper and lower housings have different levels of vertical rigidity.

6 Claims, 13 Drawing Sheets

CLUSTER TYPE MULTISTAGE ROLLING MILL

BACKGROUND OF THE INVENTION

The present invention relates to a cluster type multistage rolling mill, and particularly, to a cluster type split housing type rolling mill in which a housing containing a group of rolls is split into a top inner housing containing the upper half of the group of rolls and a bottom inner housing containing the lower half of the group of rolls, and the top and the bottom inner housings are contained in outer housings of an operating side and a driving side.

In recent years, users' requirements for properties of plate materials manufactured by rolling of various kinds of materials have become increasingly severe, and it is required to control the plate thickness to a high degree of accuracy. A 20-stage rolling mill of an integral mono-block type having been widely used is good in accuracy of plate thickness because of the small deflection in work roll and the high rigidity of mill. However, because the gap of work rolls is small due to the geometric dimensional relationship caused by the integral housing, there are disadvantages in that it is difficult to perform plate passing work and that it is difficult to remove plate cobbles when rolled material rupture accident occurs. In order to solve these problems of the 20-stage rolling mill of an integral housing type, there has been provided a cluster type split housing type rolling mill in which a housing containing a group of rolls is split into a top inner housing containing the upper half of the group of rolls and a bottom inner housing containing the lower half of the group of rolls, and the top and the bottom inner housings are contained in outer housings of an operating side and a driving side. For example, a rolling mill of such a kind is disclosed in Japanese Patent Publication No. 50-24902. The rolling mill has a structure capable of increasing the work roll gap. Further, a cluster type split housing type rolling mill having the similar structure is also provided abroad, as described, for example, in SYMPOSIUM ON PRODUCTION TECHNOLOGY, 1993. In the rolling mill, the top and the bottom inner housings are equally split, and the top inner housing is supported by the operating side and the driving side outer housings each at two points.

However, the conventional cluster type split housing type rolling mills have a disadvantage in that the mill rigidity is too low to decrease the plate thickness accurately because the housing is split.

That is, in the cluster type split housing type rolling mill disclosed in Japanese Patent Publication No.50-24902, the top and the bottom inner housings are equally split, and the upper sides of the top inner housing are supported by the operating side and the driving side outer housings each at one central point through pass line adjusting mechanisms, and the lower sides of the bottom inner housing are supported by the operating side and the driving side outer housings each at one central point through pressing-down cylinders. Therefore, the top and the bottom inner housings are easily deformed in the horizontal direction to cause bore opening in the housings by the horizontal component (horizontal load) of the milling reaction force acting through four backing bearings arranged in the top and lower both sides. The bore opening horizontally moves the backing bearings to cause detaching of the top and the lower work rolls from the plate. Therefore, the cluster type split housing type rolling mill exhibits mill rigidity which is too low to decrease the plate thickness accurately.

In the cluster type split housing type rolling mill described in SYMPOSIUM ON PRODUCTION TECHNOLOGY, 1993, although the upper side of the top inner housing is supported by the operating side and the driving side outer housings each at the two points, it is the same as the rolling mill disclosed in Japanese Patent Publication No. 50-24902 that the top and the bottom inner housings are equally split and that the lower side of the bottom inner housing is supported by the operating side and the driving side outer housings each at one point. Therefore, there is a problem in that the mill rigidity is decreased due to the large bore opening.

As described above, in the conventional cluster type split housing type rolling mills, optimizing design in regard to the mill rigidity due to the bore opening is not performed.

SUMMARY OF THE INVENTION

An object of the present invention is to provide a cluster type split housing type rolling mill which controls plate thickness by increasing mill rigidity.

(1) In order to attain the above-mentioned object, a cluster type multistage rolling mill in accordance with the present invention is a cluster type multistage rolling mill comprising a top inner housing for containing a group of rolls arranged above a pass line; a bottom inner housing for containing a group of rolls arranged below the pass line; and operating side and driving side outer housings for containing the top and said bottom inner housings, which comprises a top side supporting means for supporting the upper side of the top inner housing to the outer housings in the operating side and the driving side each at two points in the front side and in the back side with respect to a pass direction, the top side supporting means being arranged in the upper side of the top inner housing and between the operating side and the driving side outer housings; and a bottom side supporting means for supporting the lower side of the bottom inner housing to the outer housings in the operating side and the driving side each at two points in the front side and in the back side with respect to the pass direction, the bottom side supporting means being arranged in the lower side of the bottom inner housing and between the operating side and the driving side outer housings.

By supporting the top and bottom inner housings in the both sides of the operating side and the driving side each at two points not at one point, as described above, the displacements of backing bearings in the both sides of the top and the bottom sides caused by the components of rolling load can be made small, and reduction of the mill rigidity can be suppressed. Therefore, rolling stable and good in plate thickness control capability can be performed.

(2) Further, in order to attain the above-mentioned object, a cluster type multistage rolling mill in accordance with the present invention is a cluster type multistage rolling mill comprising a top inner housing for containing a group of rolls arranged above a pass line; a bottom inner housing for containing a group of rolls arranged below the pass line; and operating side and driving side outer housings for containing the top and the bottom inner housings, which comprises a top side supporting means for supporting the upper side of the top inner housing to the outer housings in the operating side and the driving side each at two points in the front side and in the back side with respect to a pass direction, the top side supporting means being arranged in the upper side of the top inner housing and between the operating side and the driving side outer housings; and a bottom side supporting means for supporting the lower side of the bottom inner housing to the outer housings in the operating side and the driving side each at one point in the middle with respect to the pass direction, the bottom side supporting means being arranged in the lower side of the bottom inner housing and between the operating side and the driving side outer housings, wherein when a vertical rigidity ratio between the top and the bottom inner housings is defined as a rigidity of the top inner housing/a rigidity of the bottom inner housing, the housing proportion is formed so that the vertical rigidity ratio may become a value within a range of 1.02 to 1.18.

By supporting the top inner housing in the both sides of the operating side and the driving side each at two points not at one point, as described above, the displacements of backing bearings in the both sides caused by the components of rolling load can be made small, and reduction of the mill rigidity can be suppressed. Further, by setting the vertical rigidity ratio between the top and the bottom inner housings to a value within the range of 1.02 to 1.18 on the premise of the above, the total rigidity of the top and the bottom inner housings can be increased compared to that in a case where the vertical rigidity ratio between the top and the bottom inner housings is 1 (one), and as the result, reduction of the rigidity of the top and the bottom inner housings can be suppressed. Therefore, rolling stable and good in plate thickness control capability can be performed.

(3) Further, in order to attain the above-mentioned object, a cluster type multistage rolling mill in accordance with the present invention is a cluster type multistage rolling mill comprising a top inner housing for containing a group of rolls arranged above a pass line; a bottom inner housing for containing a group of rolls arranged below the pass line; and operating side and driving side outer housings for containing the top and the bottom inner housings, which comprises a top side supporting means for supporting the upper side of the top inner housing to the outer housings in the operating side and the driving side each at two points in the front side and in the back side with respect to a pass direction, the top side supporting means being arranged in the upper side of the top inner housing and between the operating side and the driving side outer housings; and a bottom side supporting means for supporting the lower side of the bottom inner housing to the outer housings in the operating side and the driving side each at one point in the middle with respect to the pass direction, the bottom side supporting means being arranged in the lower side of the bottom inner housing and between the operating side and the driving side outer housings, wherein a height of the bottom inner housing is higher than a height of the top inner housing.

By supporting the top inner housing in the both sides of the operating side and the driving side each at two points not at one point, as described above, the displacements of backing bearings in the both sides caused by the components of rolling load can be made small, and reduction of the mill rigidity can be suppressed. Further, by forming the height of the bottom inner housing higher than the height of the top inner housing on the premise of the above, the total rigidity of the top and the bottom inner housings can be increased compared to that in a case where the heights of the top and the bottom inner housings are equal to each other. Therefore, rolling stable and good in plate thickness control capability can be performed.

(4) In the above item (3), it is preferable that a height ratio of the top inner housing to the bottom inner housing is within a range of 0.72 to 0.98.

By doing so, the vertical rigidity ratio between the top and the bottom inner housings becomes a value within a range of 1.02 to 1.18. Therefore, rolling stable and good in plate thickness control capability can be performed.

(5) Further, in order to attain the above-mentioned object, a cluster type multistage rolling mill in accordance with the present invention is a cluster type multistage rolling mill comprising a top inner housing for containing a group of rolls arranged above a pass line; a bottom inner housing for containing a group of rolls arranged below the pass line; and operating side and driving side outer housings for containing the top and the bottom inner housings, Which comprises a top side supporting means for supporting the upper side of the top inner housing to the outer housings in the operating side and the driving side each at two Points in the front side and in the back side with respect to a pass direction, the top side supporting means being arranged in the upper side of the top inner housing and between the operating side and the driving side outer housings; and a bottom side supporting means for supporting the lower side of the bottom inner housing to the outer housings in the operating side and the driving side each at one Point in the middle with respect to the pass direction, the bottom side supporting means being arranged in the lower side of the bottom inner housing and between the operating side and the driving side outer housings, wherein a width in the pass direction of the bottom inner housing is wider than a width in the pass direction of the top inner housing.

By supporting the top inner housing in the both sides of the operating side and the driving side each at two points not at one point, as described above, the displacements of backing bearings in the both sides caused by the components of rolling load can be made small, and reduction of the mill rigidity can be suppressed. Further, by forming the width of the bottom inner housing wider than the width of the top inner housing on the premise of the above, the total rigidity of the top and the bottom inner housings can be increased compared to that in a case where the widths of the top and the bottom inner housings are equal to each other. Therefore, rolling stable and good in plate thickness control capability can be performed.

(6) In the above item (5), it is preferable that a width ratio of the top inner housing to the bottom inner housing is within a range of 0.72 to 0.98.

By doing so, the vertical rigidity ratio between the top and the bottom inner housings becomes a value within a range of 1.02 to 1.18. Therefore, rolling stable and good in plate thickness control capability can be performed.

EXPLANATION OF REFERENCE NUMBERS USED IN THE DRAWINGS

| | |
|---|---|
| 1 | work roll |
| 2 | first intermediate roll |
| 3 | second intermediate roll |
| 4 | backing bearing |
| 5 | top roll group |
| 6 | bottom roll group |
| 8, 8A, 8B | top inner housing |
| 9, 9A, 9B | bottom inner housing |
| 10, 11 | outer housing |
| 15, 16 | pass line adjusting mechanism |
| 17, 18, 20 | pressing-down cylinder |

DESCRIPTION OF THE PREFERED EMBODIMENTS OF THE INVENTION

Embodiments will be described below, referring to the accompanied drawings.

Figure 1:
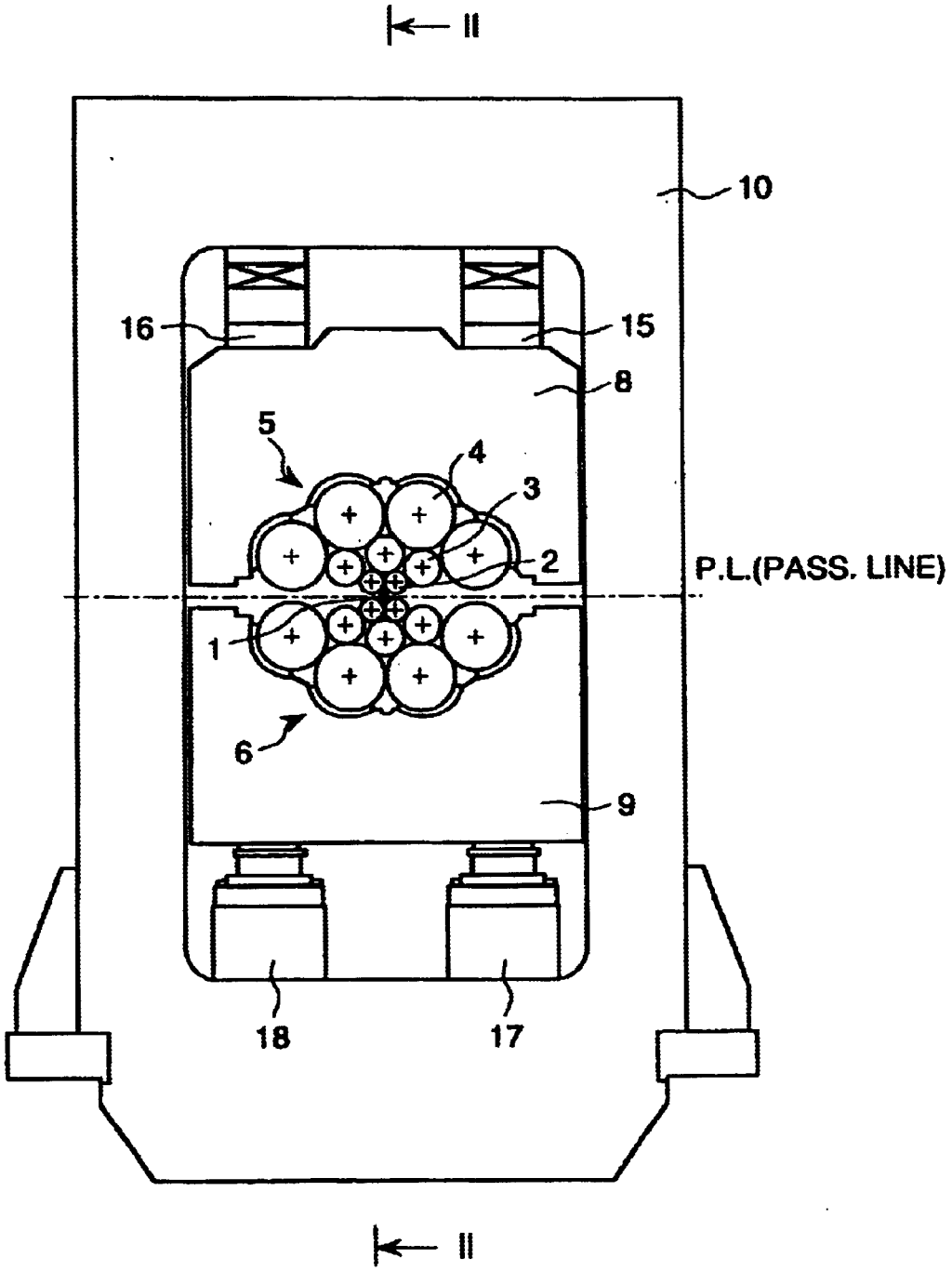
FIG. 1 is a front view showing a first embodiment of a cluster type multistage rolling mill in accordance with the present invention.
Figure 2:
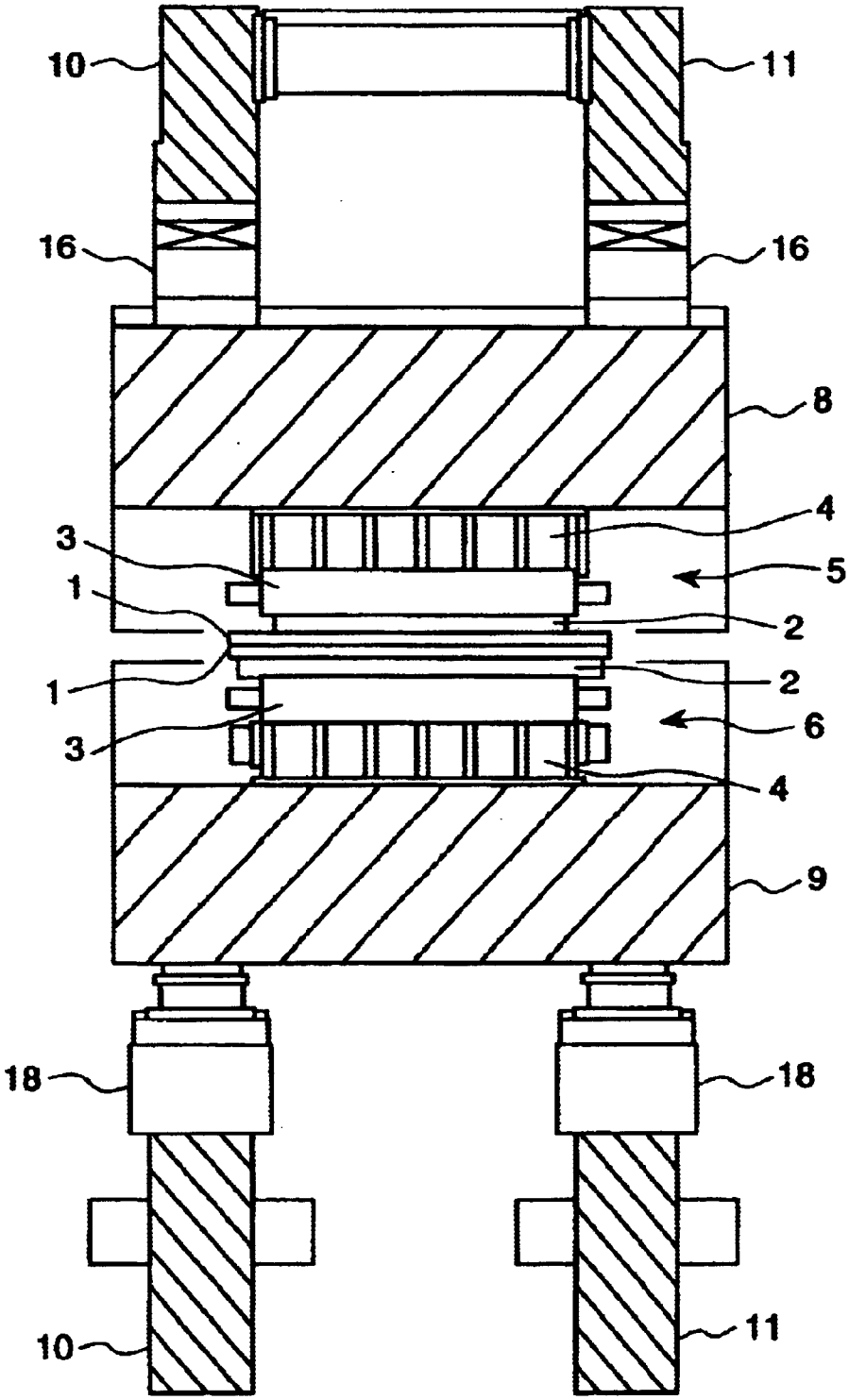
FIG. 2 is a cross-sectional view showing the first embodiment of the cluster type multistage rolling mill being taken on the plane of the lines II—II of FIG. 1.

FIG. 1 is a front view showing a first embodiment of a cluster type multistage rolling mill in accordance with the present invention, and FIG. 2 is a cross-sectional view showing the cluster type multistage rolling mill being taken on the plane of the lines II—II of FIG. 1. In the present embodiment, both of the top and the bottom inner housings are supported to the outer housings in the both sides of the operating side and the driving side each at two points.

Referring to FIG. 1 and FIG. 2, the cluster type multistage rolling mill in accordance with the present embodiment comprises a top roll group 5 arranged above a pass line PL; a bottom roll group 6 arranged below the pass line PL; a top inner housing 8 for containing the top roll group 5; a bottom inner housing 9 for containing the bottom roll group 6; and operating side and driving side outer housings 10, 11 for containing the top and the bottom inner housings 8, 9. Each of the top and the bottom roll groups 5, 6 has a work V roll 1; first intermediate rolls 2; second intermediate rolls 3 and backing bearings 4. Number of the work rolls 1 is one for each of the top and the bottom inner housings, number of the first intermediate rolls 2 is two for each of the top and the bottom inner housings, number of the second intermediate rolls 3 is three for each of the top and the bottom inner housings, and number of the backing bearings 4 is four for each of the top and the bottom inner housings. As described above, the present embodiment of the cluster type multistage rolling mill is a multistage rolling mill of a 20-stage split housing type.

Two pass line adjusting mechanisms 15, 16 are arranged between the operating side and the driving side outer housings 10, 11 in the upper side of the top inner housing 8, and rocker plates of these two pass line adjusting mechanisms 15, 16 form a top side supporting means for supporting the upper side of the top inner housing 8 to the outer housings 10, 11 in the operating side and the driving side each at two points in the front side and in the back side with respect to a pass direction. Further, two press-down cylinders 17, 18 are arranged between the operating side and the driving side outer housings 10, 11 in the lower side of the bottom inner housing 9, and rocker plates of these two press-down cylinders 17, 18 form a bottom side supporting means for supporting the lower side of the bottom inner housing 9 to the outer housings 10, 11 in the operating side and the driving side each at two points in the front side and in the back side with respect to the pass direction.

The mill rigidity of the conventional cluster type split housing type 20-stage rolling mill is reduced compared to that of a mono-block type 20-stage rolling mill of an equal size because the inner housing is split. One of the factors to reduce the rigidity will be explained below, referring to FIG. 3 and FIG. 4.

Figure 3:
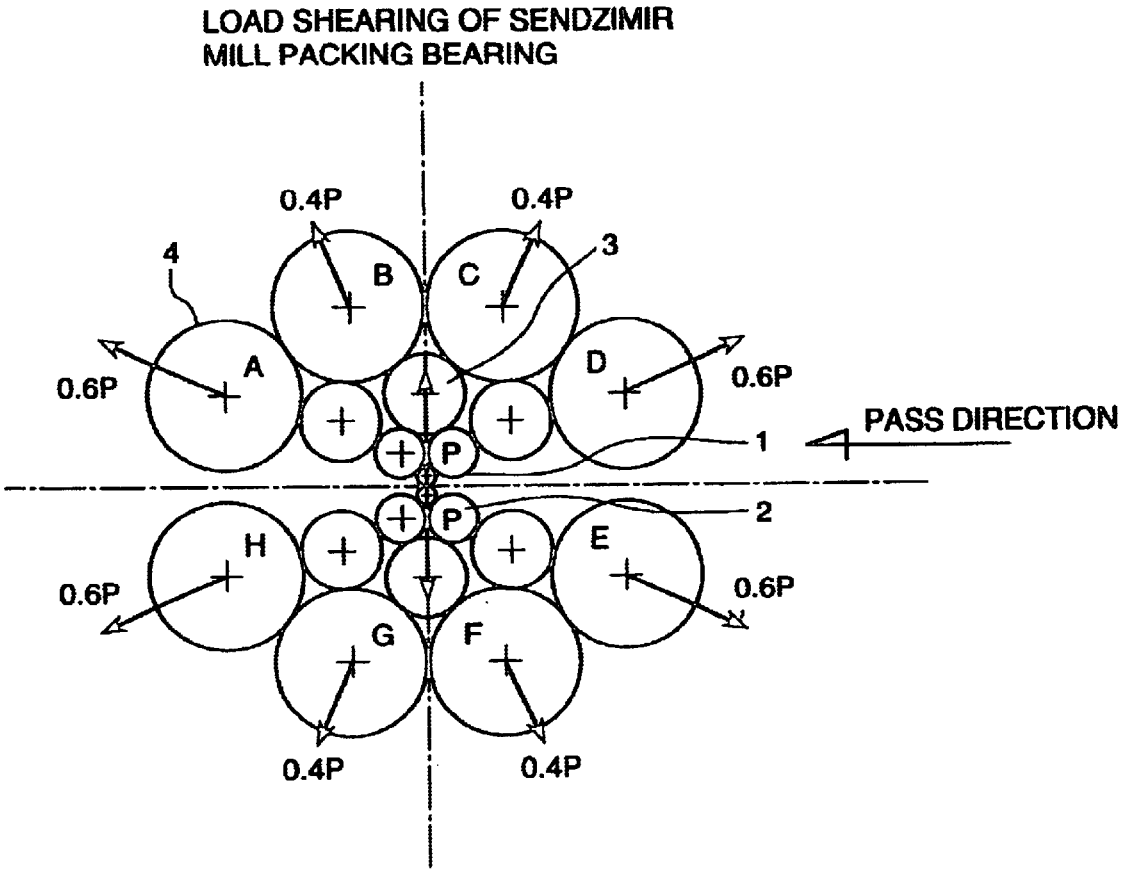
FIG. 3 is a view showing an example of load distribution in backing bearings in a 20-stage rolling mill.

FIG. 3 is a view showing an example of load distribution in backing bearings in a 20-stage rolling mill. In the figure, the reference characters A to H indicate positions of the individual backing bearings 4. The backing bearings 4 at the positions A, D, E, H in the top and the bottom sides among these backing bearings 4 are burdened with 60% of the rolling reaction force. The load direction of shafts of the backing bearings 4 at the positions A, D, E, H is nearly horizontal, and the housings are deformed in the horizontal direction by the load.

Figure 4:
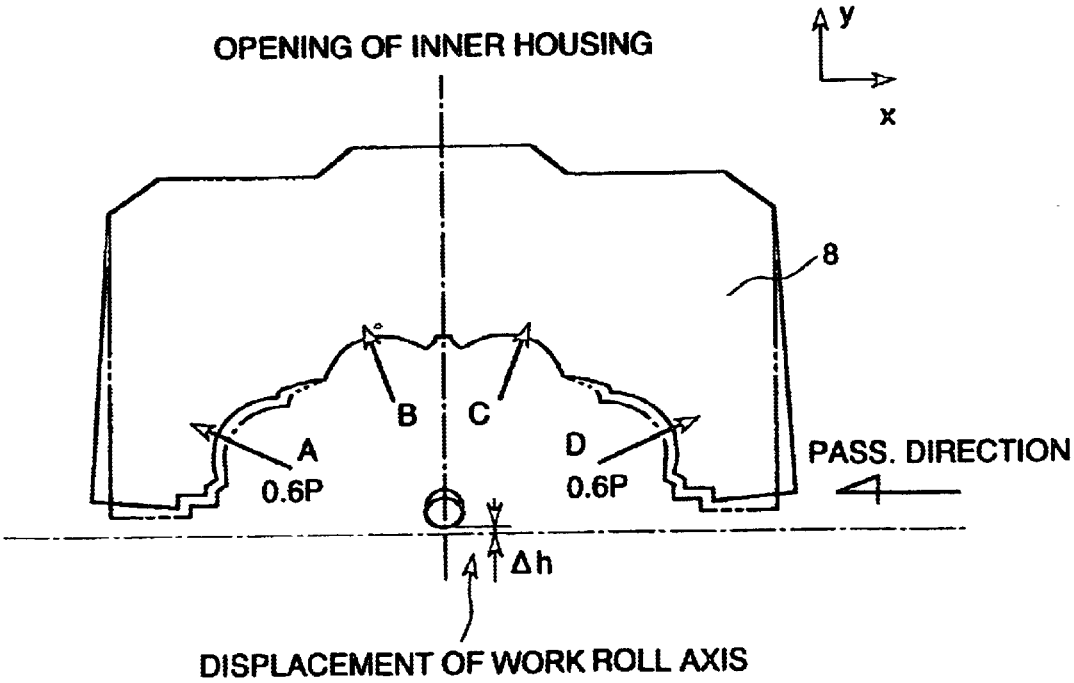
FIG. 4 is a diagram showing deformation (bore opening) of a top inner housing in a split housing type 20-stage rolling mill.

FIG. 4 is a diagram showing deformation (bore opening) of a top inner housing in a split housing type 20-stage rolling mill. Deformation in the housing caused by the backing bearings 4 at the positions A, D, E, H burdened with 60% of the rolling reaction force becomes larger by splitting the housing. This phenomenon is called bore opening of the housing. The same can be said in the bottom inner housing 9.

Horizontal moving of the backing bearings 4 by the bore opening causes detaching of the positions of the top and the bottom work rolls from the plate. Therefore, larger bore opening occurs to reduce the mill rigidity in the split housing type rolling mill compared to in an integrated mono-block housing 20-stage rolling mill.

In order to solve the problem described above, the inventors of the present invention directed their attention to the fact that the horizontally directional load of the shafts of the backing bearing at the positions A, D, E, H causes the bore opening to accelerate reduction of the mill rigidity, and studied on the supporting positions and the proportion of the inner housings capable of effectively suppressing the deformation of the inner housings, and as the result, proposed the present invention by finding that the above-mentioned problem could be solved.

Operation of the present invention will be described below.

Figure 5:
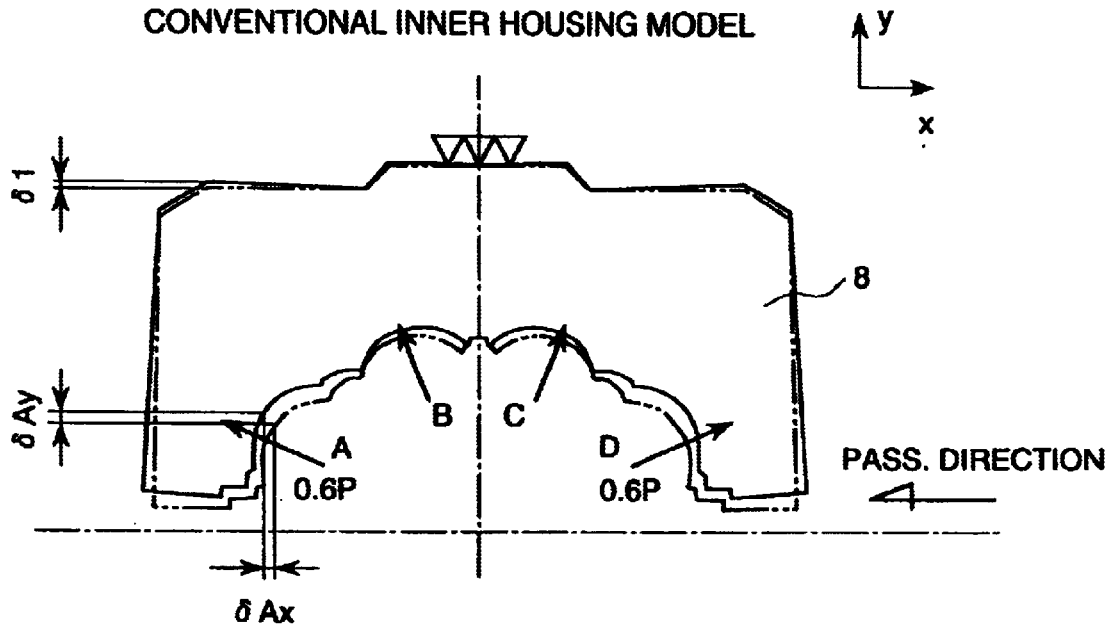
FIG. 5 (PRIOR ART)
FIG. 5 is a diagram showing a simplified model of a top inner housing of a conventional split housing type multistage rolling mill.
Figure 6:
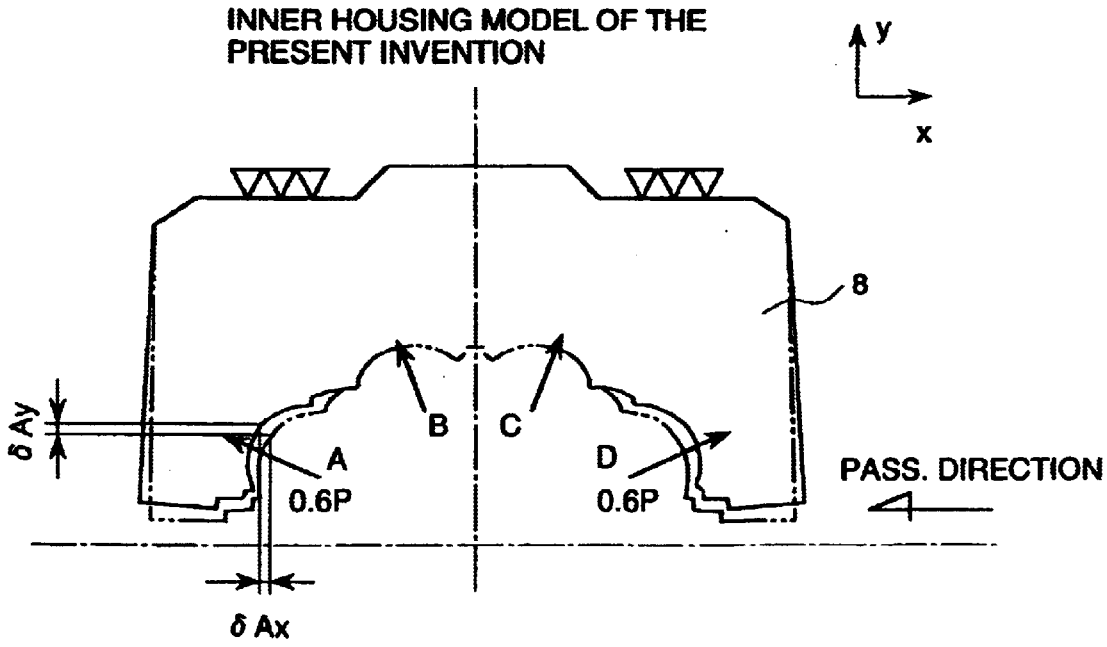
FIG. 6 is a diagram showing a model of an inner housing in accordance with the present invention.

Here, the bore opening of the inner housing 8 caused by the components of the rolling load acting on the backing bearings 4 at the positions A, D of the top inner housing 8 is considered. FIG. 5 is a diagram showing a simplified model of the top inner housing of a conventional split housing type multistage rolling mill, and there is one restriction point in the middle. FIG. 6 is a diagram showing a model of the top inner housing in accordance with the present invention, and the restriction points are placed at the both of the front and the rear ends in the pass direction, but not at the middle point as shown in FIG. 5.

Considering the displacements δAx, δAy in the backing bearing 4 at the position A (the same can be said to the bearings at the positions D, E, H), it can be easily estimated that in the case of the conventional rolling mill, the displacements δ1 generated at the both of the front and the rear ends in the pass direction in the upper side of the top inner housing affect on the displacements δAx, δAy, and accordingly that the displacements δAx, δAy in the conventional rolling mill become larger compared to those in the present invention.

The inventors of the present invention have found that if the displacements $\delta_{IJ}$ in the x- and the y-directions of the backing bearings 4 at the positions A, B, C, D are known, the following linear relationship between each of the displacements $\delta_{IJ}$ and the vertical displacement $\Delta_{IY}$ of the work roll can be obtained, and therefore, if the displacement $\delta_{IJ}$ in the x- and the y-directions of each of the backing bearings 4 at the positions A, B, C, D are known, the displacement Δh of the work roll shaft in the vertical direction can be calculated as the total sum of Δ using the relationship.

$$\Delta=\alpha_{IX}\times\delta_{IJ}+\alpha_{IY}\times\delta_{IY} \quad (1)$$

where $\alpha_{IJ}$ is a proportional constant, the suffix I indicates the position of the backing bearing (A to H), and the suffix J indicates the direction (x, y).

In more detail, the displacement of the work roll shaft in the top inner housing Δht is calculated from Equation (2), and the displacement of the work roll shaft in the bottom inner housing Δ hb is calculated from Equation (3).

$$\Delta ht=\Delta Ay+\Delta By \quad (2)$$

From the positional symmetricalness, the combination of C and D can be substituted for the combination of A and B.

$$\Delta hb=\Delta Hy+\Delta Gy \quad (3)$$

From the positional symmetricalness, the combination of F and F can be substituted for the combination of G and H.

A vertical rigidity K of the total of the top and the bottom inner housings is calculated from the following equation.

$$K=P/(\Delta ht+\Delta hb) \quad (4)$$

It is clear from Equations (1) to (4) that compared to the case where the restriction point is placed in the middle position as shown in FIG. 5, in the case where the restriction points are placed at the two positions in the front side and the rear side in the pass direction, that is, at four positions in the operating side and the driving side in total, as shown in FIG. 6, the displacement $\delta_{IJ}$ can be suppressed to a smaller value and accordingly the vertical displacement Δh of the work roll can be suppressed to a small value to improve the vertical rigidity of the mill.

In regard to the restriction points in the model of FIG. 6, in the present embodiment the rocker plates in the pass line adjusting mechanisms 15, 16 in the top inner housing 8 side and the rocker plates in the press-down cylinders 17, 18 in the bottom inner housing 9 side can act as the function of the restriction points (supporting means). In other words, the roll separating forces added from the work rolls 1, 1 are transmitted to the outer housings 10, 11 passing through the top inner housing 8 and through the pass line adjusting mechanisms 15, 16 in the case of the top work roll 1, and transmitted to the outer housings 10, 11 passing through the bottom inner housing 9 and through the press-down cylinders 17, 18 in the case of the top work roll 1. Further, both of the pass line adjusting mechanisms 15, 16 and the press-down cylinders 17, 18 have functions to keep the levels of the top and the bottom work rolls, that is, the pass line constant because both of the pass line adjusting mechanisms 15, 16 and the press-down cylinders 17, 18 can adjust their heights.

Therefore, according to the present embodiment, in the split housing type multistage rolling mill, reducing of the mill rigidity can be suppressed as small as possible, and rolling stable and good in plate thickness control capability can be performed.

A second embodiment in accordance with the present invention will be described below, referring to FIG. 7 and FIG. 8, and a third embodiment in accordance with the present invention will be described below, referring to FIG. 9 and FIG. 10. In the figures, components equivalent to those shown in FIG. 1 and FIG.2 are identified by the same reference characters.

In the first embodiment, the press-down cylinders are arranged at the two positions for each side of the operating side and the driving side, that is, at the four positions in total as the restriction points of the bottom inner housing. However, it can be considered that there are some cases where it is difficult from the viewpoint of economical feature and from the viewpoint of tuning ability between the both sides to arrange the press-down cylinders at the four positions. The second embodiment of FIG. 7 and FIG. 8 and the third embodiment of FIG. 9 and FIG. 10 are designed in taking the above point into consideration, and one press-down cylinder is placed at the middle position in the pass direction, and an optimum vertical rigidity is obtained by changing the proportion of the top and the bottom inner housing to change the ratio of the vertical rigidities.

Initially, the embodiment shown in FIG. 7 and FIG. 8 will be described.

Figure 7:
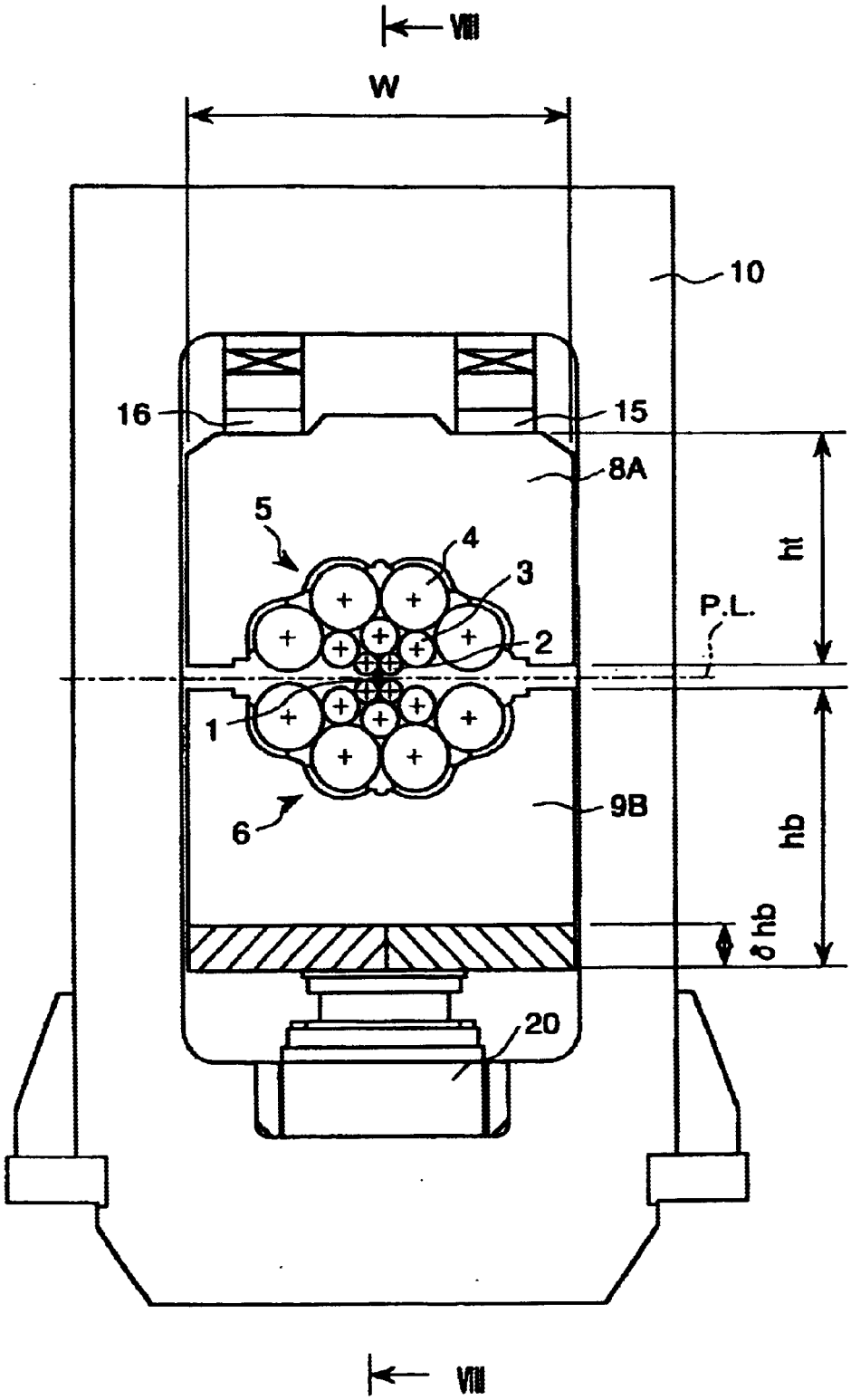
FIG. 7 is a front view showing a second embodiment of a cluster type multistage rolling mill in accordance with the present invention.
Figure 8:
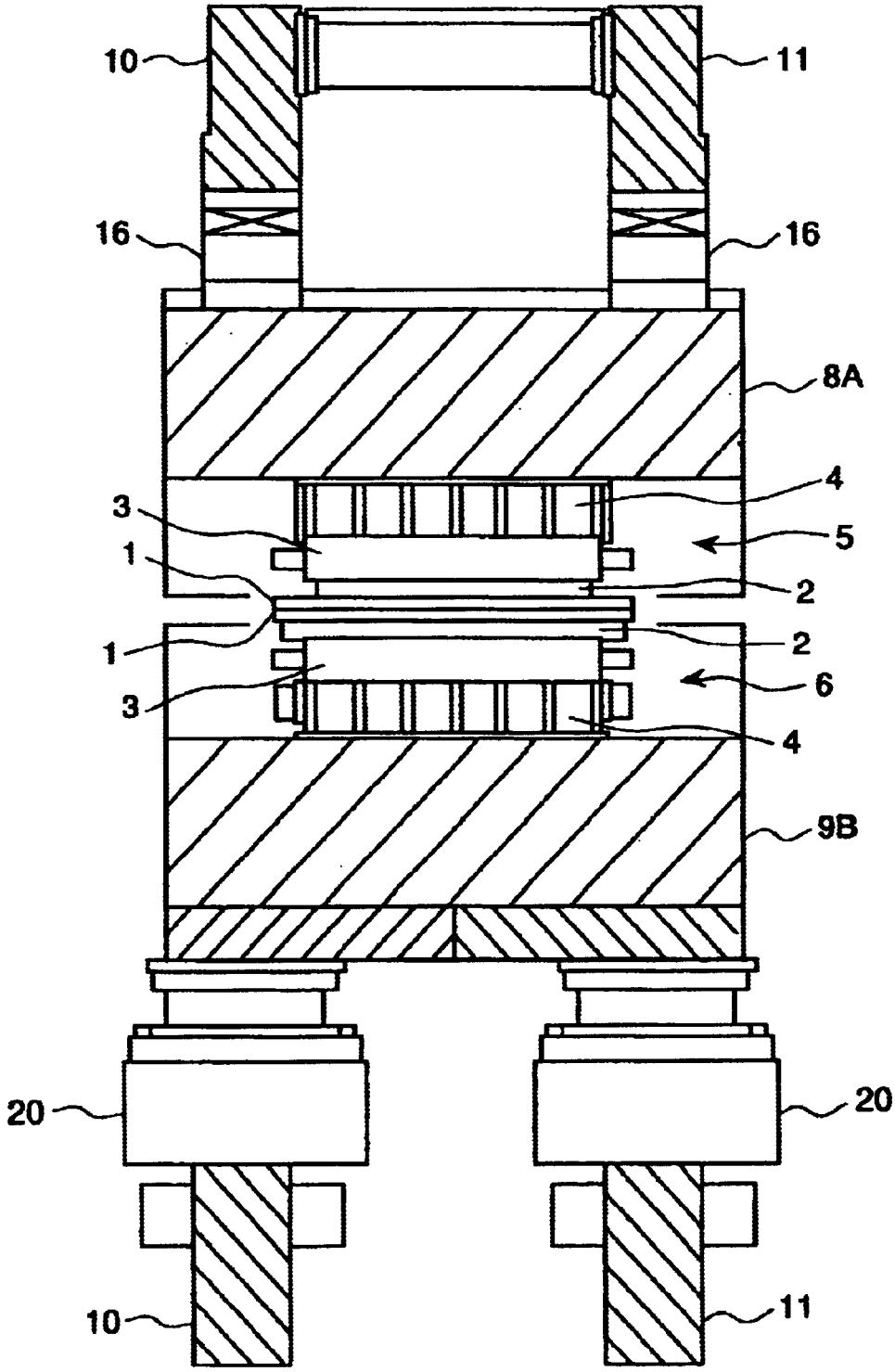
FIG. 8 is a cross-sectional view showing the second embodiment of the cluster type multistage rolling mill being taken on the plane of the lines VIII—VIII of FIG. 7.

Referring to FIG. 7 and FIG. 8, the top roll group 5 is contained in the top inner housing BA and the bottom roll group 6 is contained in the bottom inner housing 9A, and the top and the bottom inner housings 8A, 9A are contained in the operating side and the driving side outer housings 10, 11. The two pass line adjusting mechanisms 15, 16 are arranged between the operating side and the driving side outer housings 10, 11 in the upper side of the top inner housing BA, and the rocker plates of these two pass line adjusting mechanisms 15, 16 form the top side supporting means for supporting the upper side of the top inner housing BA to the outer housings 10, 11 in the operating side and the driving side each at two points in the front side and in the back side with respect to a pass Further, press-down cylinders 20 are arranged between the operating side and the driving side outer housings direction. 10, 11 in the lower side of the bottom inner housing 9A, and rocker plates of the press-down cylinders 20 form the bottom side supporting means for supporting the lower side of the bottom inner housing 9A to the outer housings 10, 11 in the operating side and the driving side each at one point in the middle position with respect to the pass direction.

Letting the width of each of the top and the bottom inner housings 8A, 9A be W, and the heights of the top and the bottom inner housings 8A, 9A be ht, hb, respectively, the widths W for the top and the bottom inner housings 8A, 9A are equal to each other, and the height hb of the bottom inner housing 9A is higher than the height ht of the top inner housing 8A by δ hb, and the rolling mill has a housing proportion that the ratio ht/hb of the heights ht, hb of the top and the bottom inner housings 8A, 9A becomes a value within a range of 0.72 to 0.98. This is equivalent to that the vertical rigidity ratio between the top and the bottom inner housings 8A, 9A (rigidity of the top inner housing/rigidity of the bottom inner housing) becomes a value within a range of 1.02 to 1.18 (to be described later).

Further, compared to the first embodiment, the width W of the top and the bottom inner housings 8A, 9A is equal to the width of the top and the bottom inner housings 8, 9 in the first embodiment, and the sum of the heights ht and hb of the top and the bottom inner housings 8A, 9A is equal to the sum of the heights ht and hb of the top and the bottom inner housings 8, 9 in the first embodiment. That is, the dimension of the whole rolling mill is the same as that in the first embodiment.

In the case where the widths W of the top and the bottom inner housings 8A, 9A are equal to each other as described above, the above-mentioned displacement δ1 in the bottom inner housing 9A can be decreased and the vertical rigidity of the bottom inner housing 9A can be increased by increasing the height of the bottom inner housing 9A by δ hb to the height of the top inner housing 8A to adjust the rigidity ratio. Further, by determining the dimension of the top and the bottom inner housing height by adjusting the ratio of the heights of the top and the bottom inner housings, design of housings securing less wasteful and economical rigidity can be performed.

Further, since the widths W of the top and the bottom inner housings are equal to each other, the present embodiment has an advantage in that when maintenance of liners between the inner housing and the outer housing is performed, the inner housings can be easily extracted compared to the embodiment to be described below in which the width ratio of the top and the bottom inner housings is changed.

The embodiment shown in FIG. 9 and FIG. 10 will be described.

Figure 9:
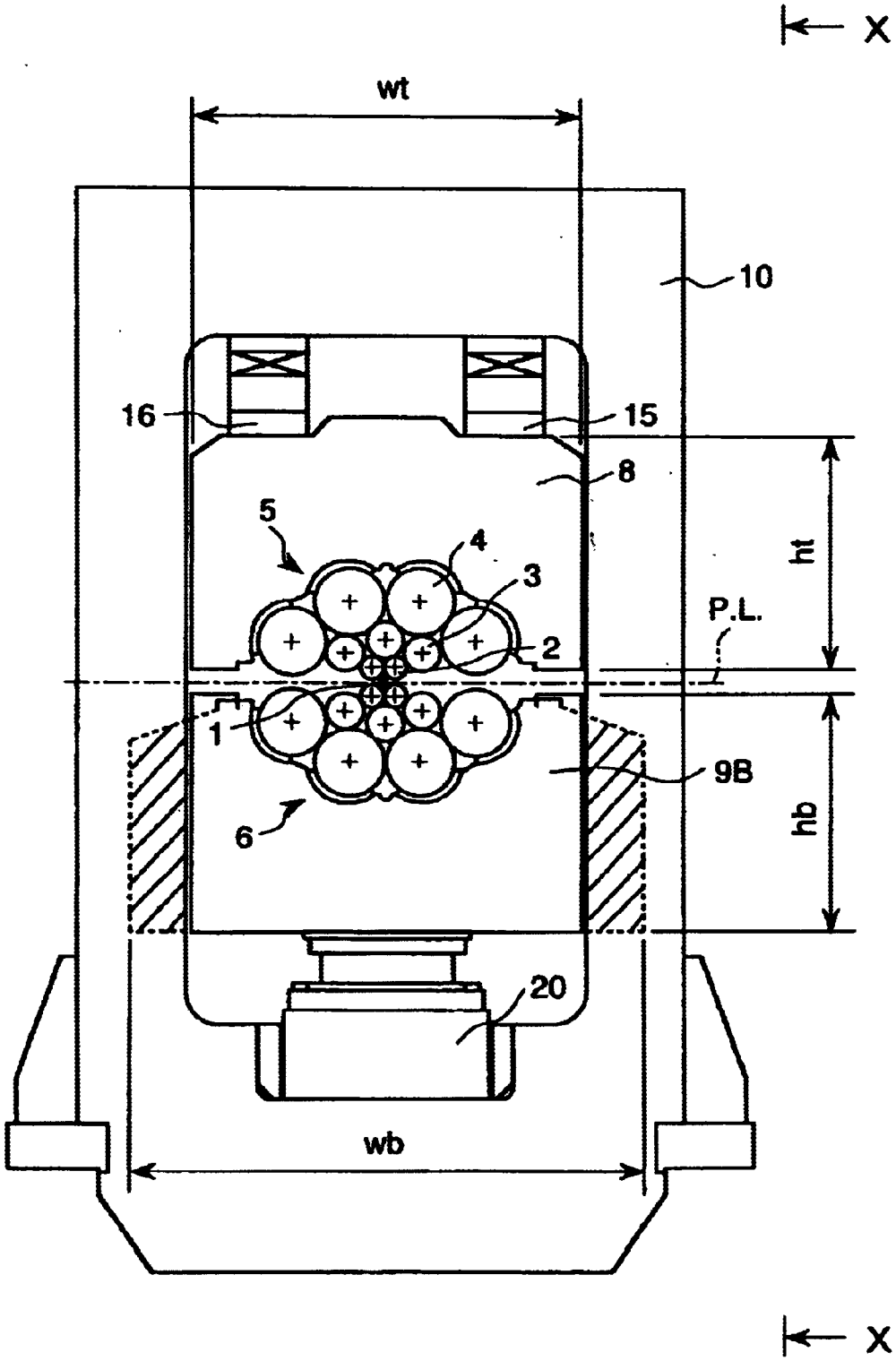
FIG. 9 is a front view showing a third embodiment of a cluster type multistage rolling mill in accordance with the present invention.
Figure 10:
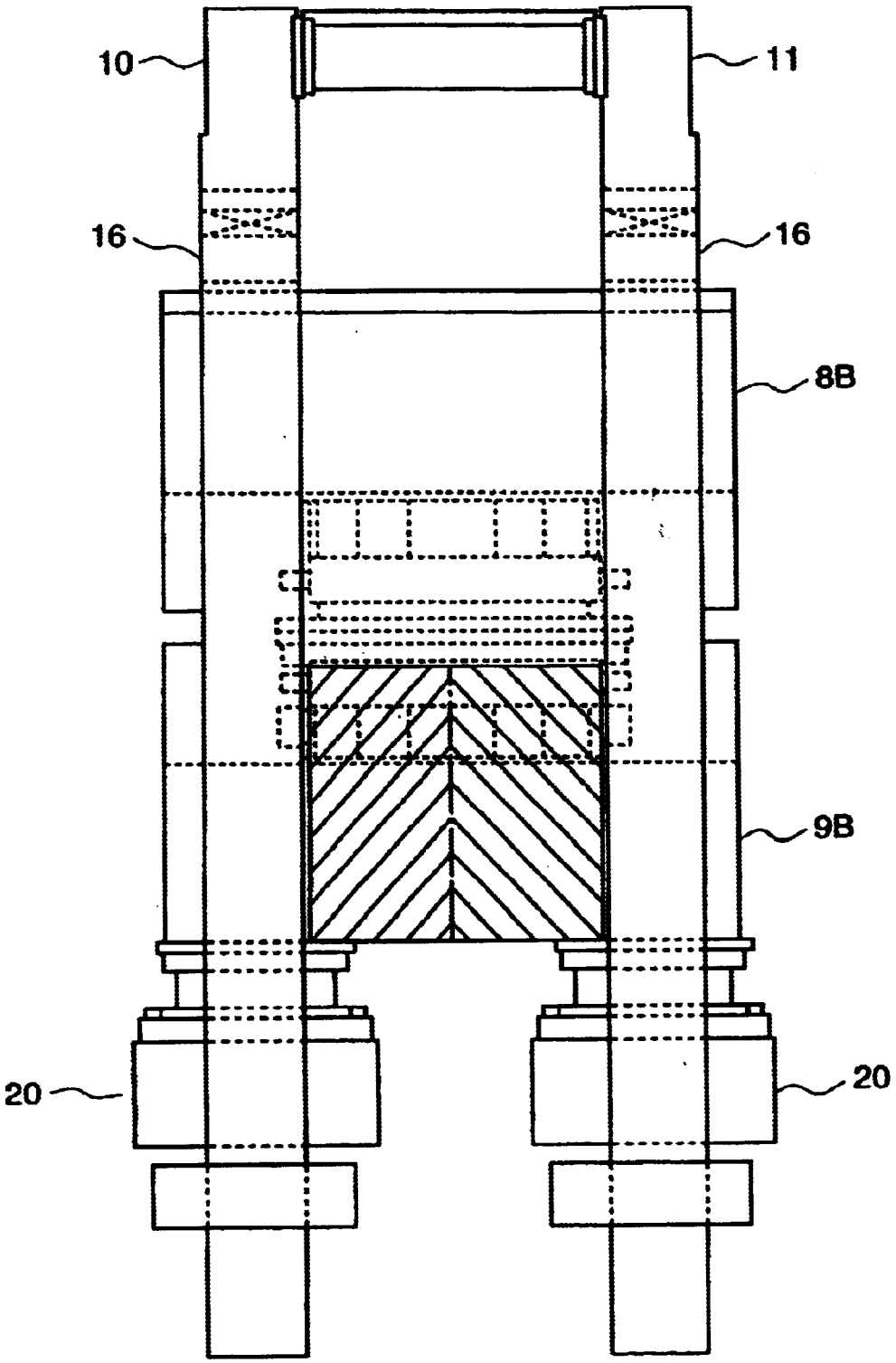
FIG. 10 is a cross-sectional view showing the third #1 embodiment of the cluster type multistage rolling mill being 7 taken on the plane of the lines X—X of FIG. 9.

Referring to FIG. 9 and FIG. 10, the top roll group 5 is contained in the top inner housing 8B and the bottom roll group 6 is contained in the bottom inner housing 9B, and the top and the bottom inner housings 8B, 9B are contained in the operating side and the driving side outer housings 10, 11. The two pass line adjusting mechanisms 15, 16 are arranged between the operating side and the driving side outer housings 10, 11 in the upper side of the top inner housing 8B, and the rocker plates of these two pass line adjusting mechanisms 15, 16 form the top side supporting means for supporting the upper side of the top inner housing 8B to the outer housings 10, 11 in the operating side and the driving side each at two points in the front side and in the back side with respect to a pass direction. Further, a press-down cylinders 20 are arranged between the operating side and the driving side outer housings 10, 11 in the lower side of the bottom inner housing 9B, and rocker plates of the press-down cylinders 20 form the bottom side supporting means for supporting the lower side of the bottom inner housing 9B to the outer housings 10, 11 in the operating side and the driving side each at one point in the middle position with respect to the pass direction.

Letting the widths of the top and the bottom inner housings 8B, 9B be wt and wb, and the heights of the top and the bottom inner housings 8B, 9B be ht and hb, respectively, the heights ht, hb for the top and the bottom inner housings 8B, 9B are equal to each other, and the width wb of the bottom inner housing 9B is wider than the width wt of the top inner housing 8B (hatched portions in FIG. 9 and FIG. 10), and the rolling mill has a housing proportion that the ratio wt/wb of the widths wt, wb of the top and the bottom inner housings 8B, 9B becomes a value within a range of 0.78 to 0.94. This is equivalent to that the vertical rigidity ratio between the top and the bottom inner housings 8A, 9A (rigidity of the top inner housing/rigidity of the bottom inner housing) becomes a value within a range of 1.02 to 1.18 (to be described later).

As described above, the rigidity ratio of the top and the bottom inner housings can be adjusted by changing the width ratio of the top and the bottom inner housings 8B, 9B, and the above-mentioned displacement δ1 in the bottom inner housing 9B can be decreased and the vertical rigidity of the bottom inner housing 9B can be increased.

The principle of operation of the second embodiment of FIG. 7 and FIG. 8 and the third embodiment of FIG. 9 and FIG. 10 will be described below, referring to FIG. 11 to FIG. 15.

Figure 11:
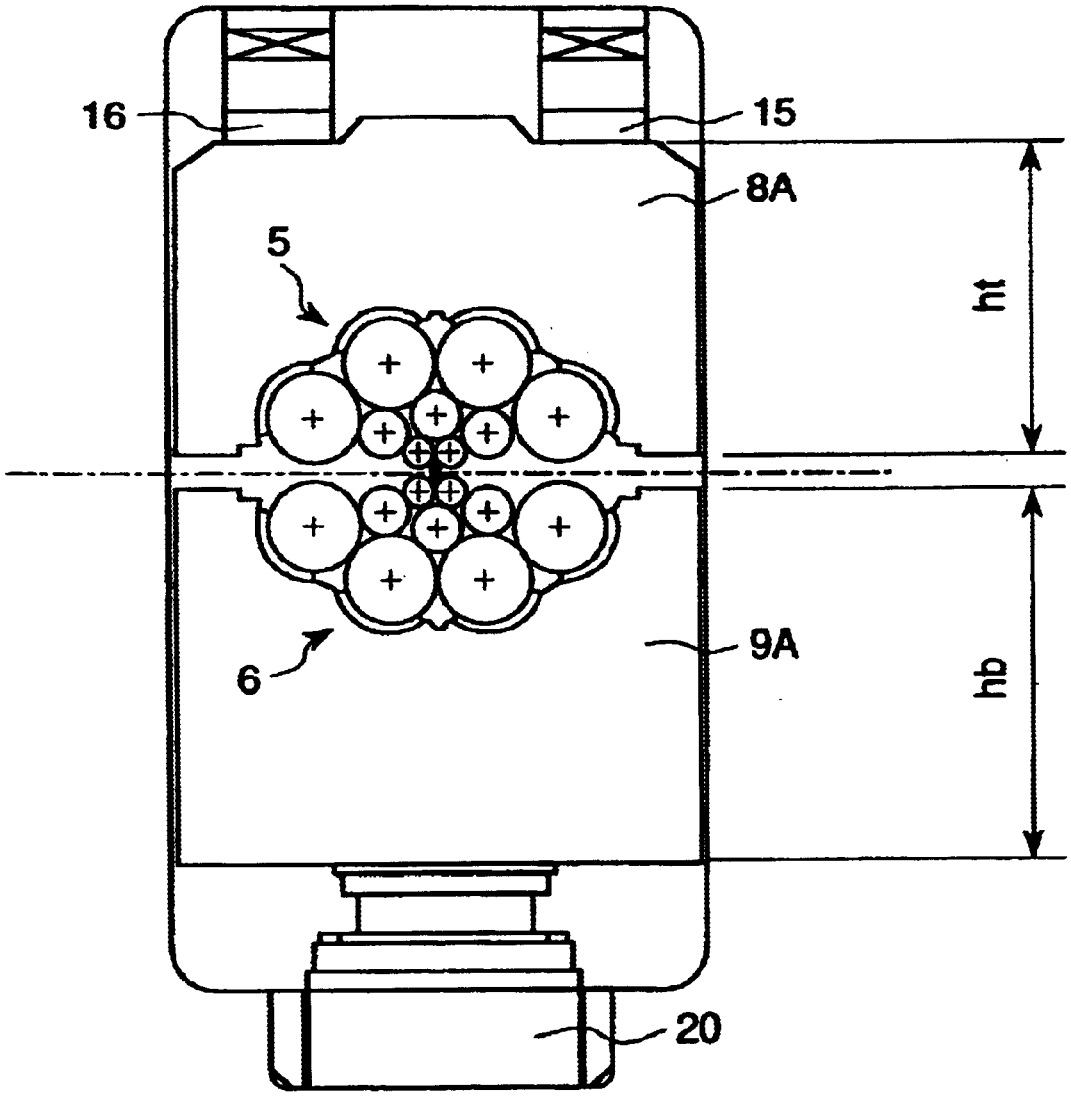
FIG. 11 is a modeling diagram of the inner housing of the second embodiment of the rolling mill.

FIG. 11 is a modeling diagram of the inner housing of the rolling mill in accordance with the second embodiment. The top inner housing 8A is restricted by the rocker plates of the pass line adjusting mechanisms 15, 16, and the bottom inner housing 9A is restricted by the rocker plate of the press-down cylinder 10 on the center of the work roll. The widths of the top and the bottom inner housings 8A, 9A are equal to each other.

Figure 12:
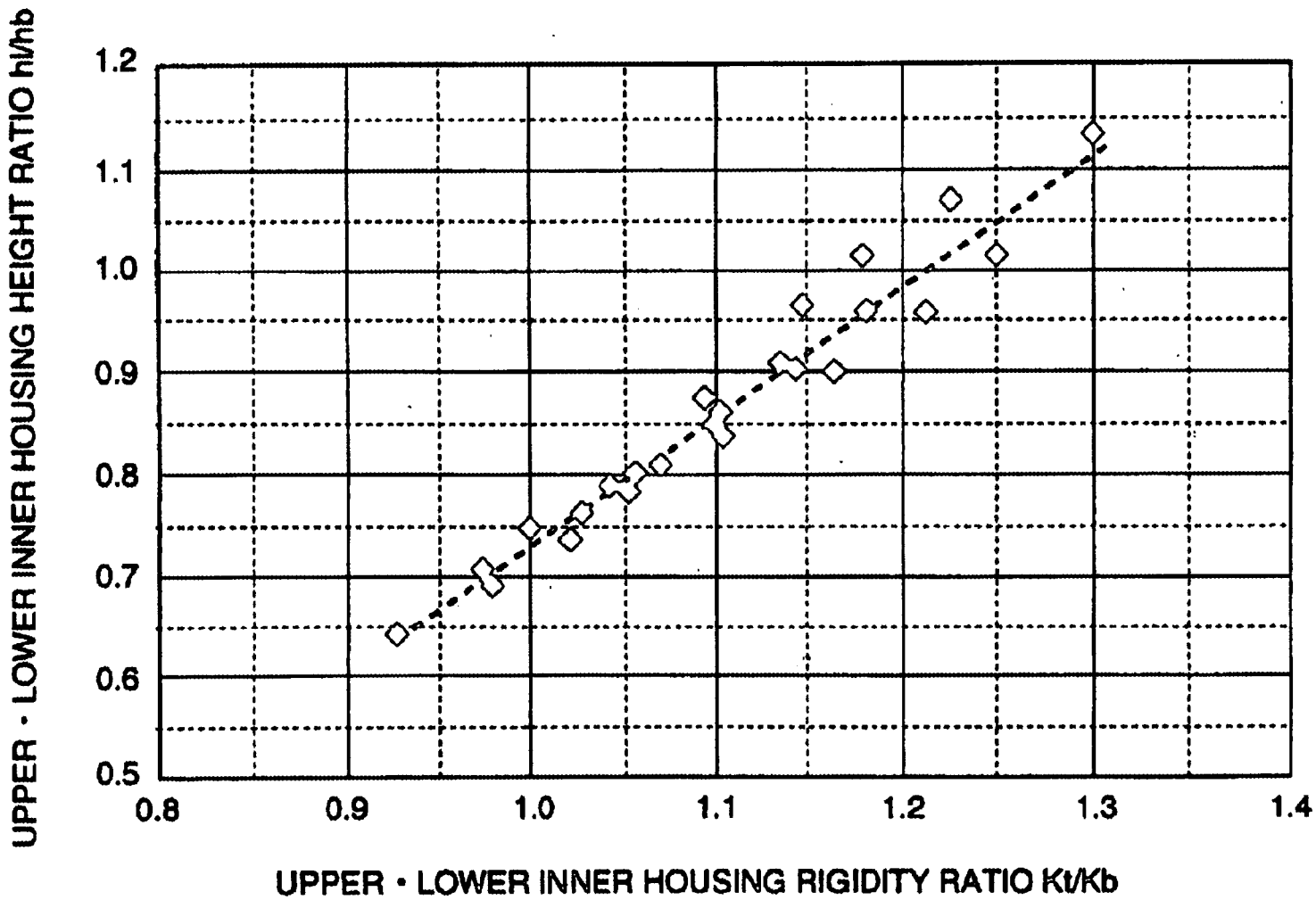
FIG. 12 is a graph showing the relationship between rigidity ratio of the top and the bottom inner housings and height ratio of the upper and the bottom inner housings.

FIG. 12 is a graph in which the rigidity ratio of the top and the bottom inner housings of the model shown in FIG. 11 is taken in the abscissa and the height ratio of the upper and the bottom inner housings is taken in the ordinate. The widths of the inner housings are the same, that is, wt=wb. The rigidities of the top and the bottom inner housings are calculated by dividing a rolling load by vertical displacements Δht, Δhb of the work roll shafts which are calculated using Equations (2), (3) from displacements $\delta_U$ of the each of the bore portions containing the top and the bottom roll groups in the top and the bottom inner housings which are calculated using three-dimensional finite-element method (FEM).

$$Kt=P/P\ \Delta ht \tag{5}$$

$$Kb=P/\Delta hb \tag{6}$$

As clear from FIG. 12, it can be understood that the rigidity of the top inner housing is higher than that of the bottom inner housing because of the difference in the restriction points of the top and the bottom inner housings, that is, the rigidity ratio is approximately 1.2 when the heights of the top and the bottom inner housings are equal to each other, that is, the height ratio is 1 (one). It is clear that in order to suppress the displacement of the work roll, it is effective to increase the height of the inner housing when the width of the inner housing is not changed. However, considering the limitation in the height of a building installing the rolling mill, cost of raw materials and manufacturing cost, it is preferable that the total inner housing height (ht+hb) is fixed to a constant value, and an optimum housing proportion is determined by combining ht and hb.

Here, the optimum proportion will be described further in detail.

Figure 13:
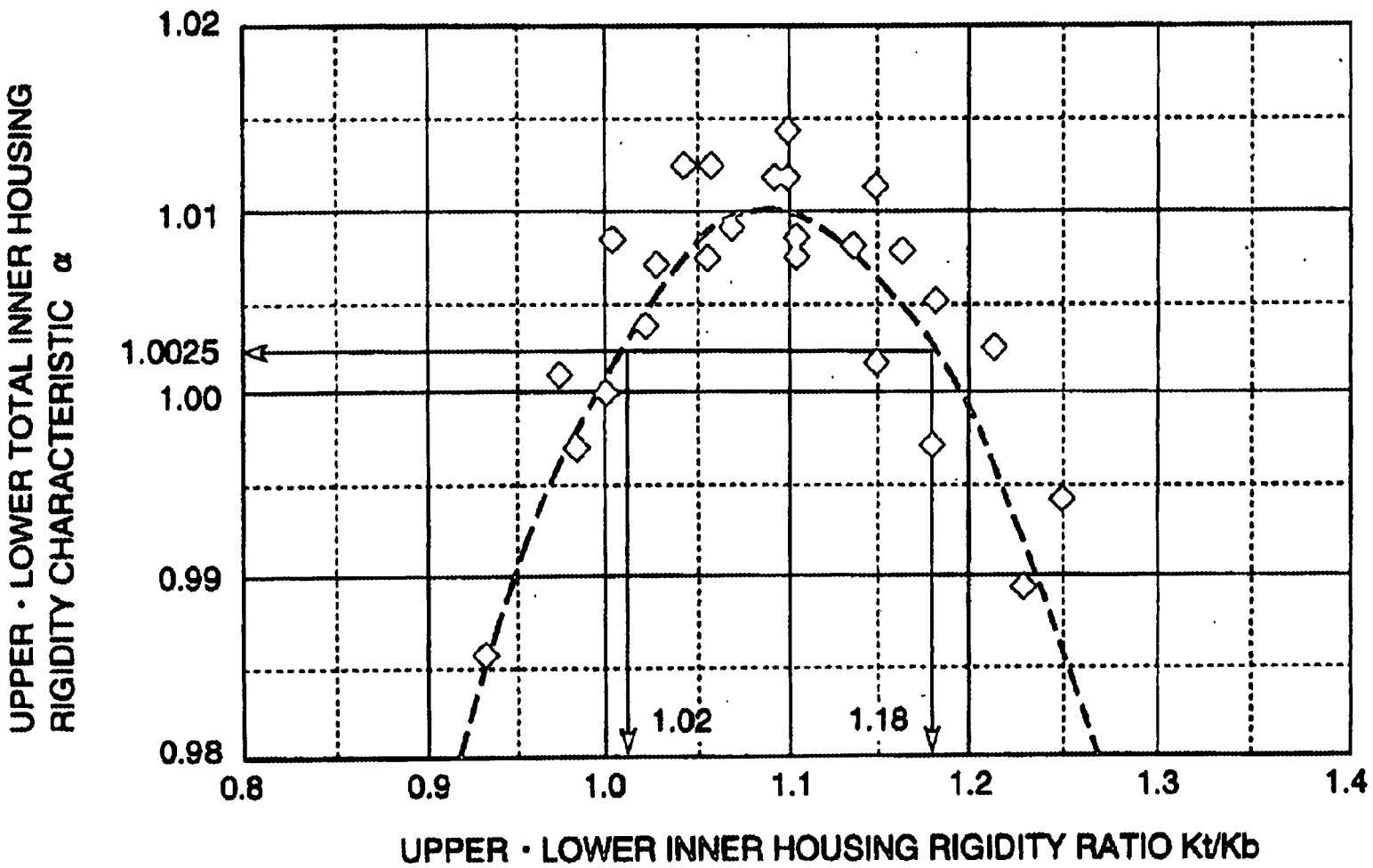
FIG. 13 is a graph showing the relationship between rigidity ratio of the top and the bottom inner housings and rigidity characteristic of total of the top and the bottom inner housings.
Figure 14:
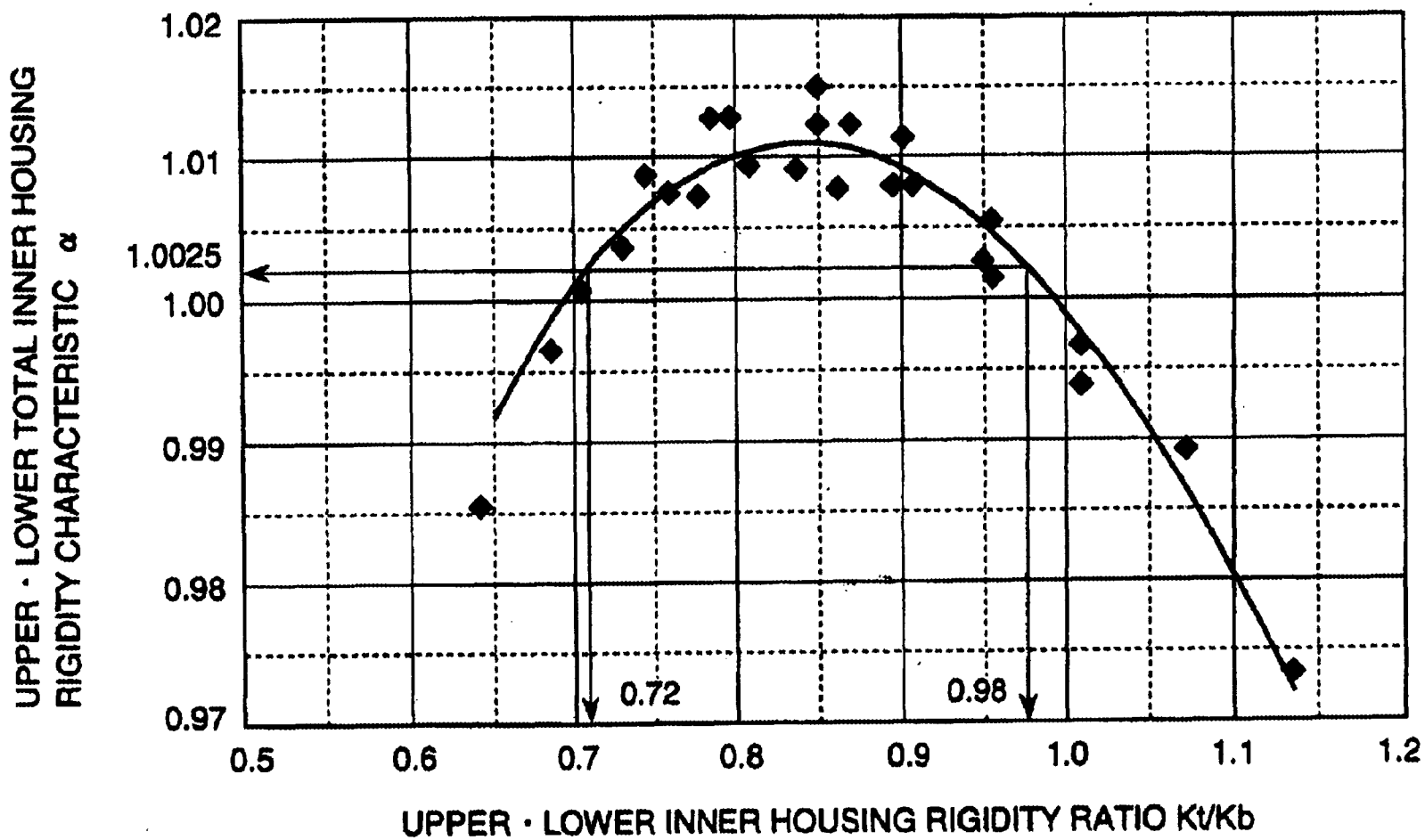
FIG. 14 is a graph showing the relationship between height ratio of the top and the bottom inner housings and rigidity characteristic of total of the top and the bottom inner housings.

FIG. 13 is a graph in which the rigidity ratio Kt/Kb of the top and the bottom inner housings is taken in the abscissa, and the ratio a of the rigidity K of total of the top and the bottom inner housings at that time to the rigidity $K_0$ of total of the top and the bottom inner housings when the rigidity ratio Kt/Kb of the top and the bottom inner housings is 1 (one) is taken in the ordinate.

The meaning of each of the symbols is related by the following equations.

$$\alpha=K/K_0 \tag{7}$$

$$K_0=P/2\Delta ht_0=P/2\Delta hb_0 \tag{8}$$

The height ht+hb of the inner housings is a constant value in either of the rigidities K, $K_0$.

It can be understood from FIG. 13 that when the rigidity ratio of the top and the bottom inner housings is kept to a value within the range of 1.02 to 1.18, the rigidity ratio a of total of the top and the bottom inner housings shows a value above 1.0025, and an optimum housing proportion can be obtained under keeping a given inner housing height ht+hb constant.

The condition of materializing the optimum housing proportion will be described below.

Since there is a linear one-to-one corresponding relationship between the ratio of the top and the bottom inner housings and the rigidity ratio of the top and the bottom inner housings when the widths of the top and the bottom inner housings are constant, the relationship between the height ratio of the top and the bottom inner housings and the rigidity ratio $\alpha$ of the total of the top and the bottom inner housings can be easily obtained.

FIG. 13 is a graph in which the height ratio ht/hb of the top and the bottom inner housings is taken in the abscissa, and the ratio $\alpha$ of the rigidity of the total of the top and the bottom inner housings at that time to the rigidity of the total of the top and the bottom inner housings when the height ratio ht/hb of the top and the bottom inner housings is 1 (one) is taken in the ordinate. It can be understood from the figure that when the height ratio of the top and the bottom inner housings is kept to a value within the range of 0.72 to 0.98, the rigidity ratio $\alpha$ of total of the top and the bottom inner housings shows a value above 1.0025, and an optimum housing proportion can be obtained under keeping a given inner housing height ht+hb constant.

On the other hand, even if the heights ht, hb of the top and the bottom inner housings are equal to each other, the rigidity can be made equivalent by making the widths of the housings different from each other.

Figure 15:
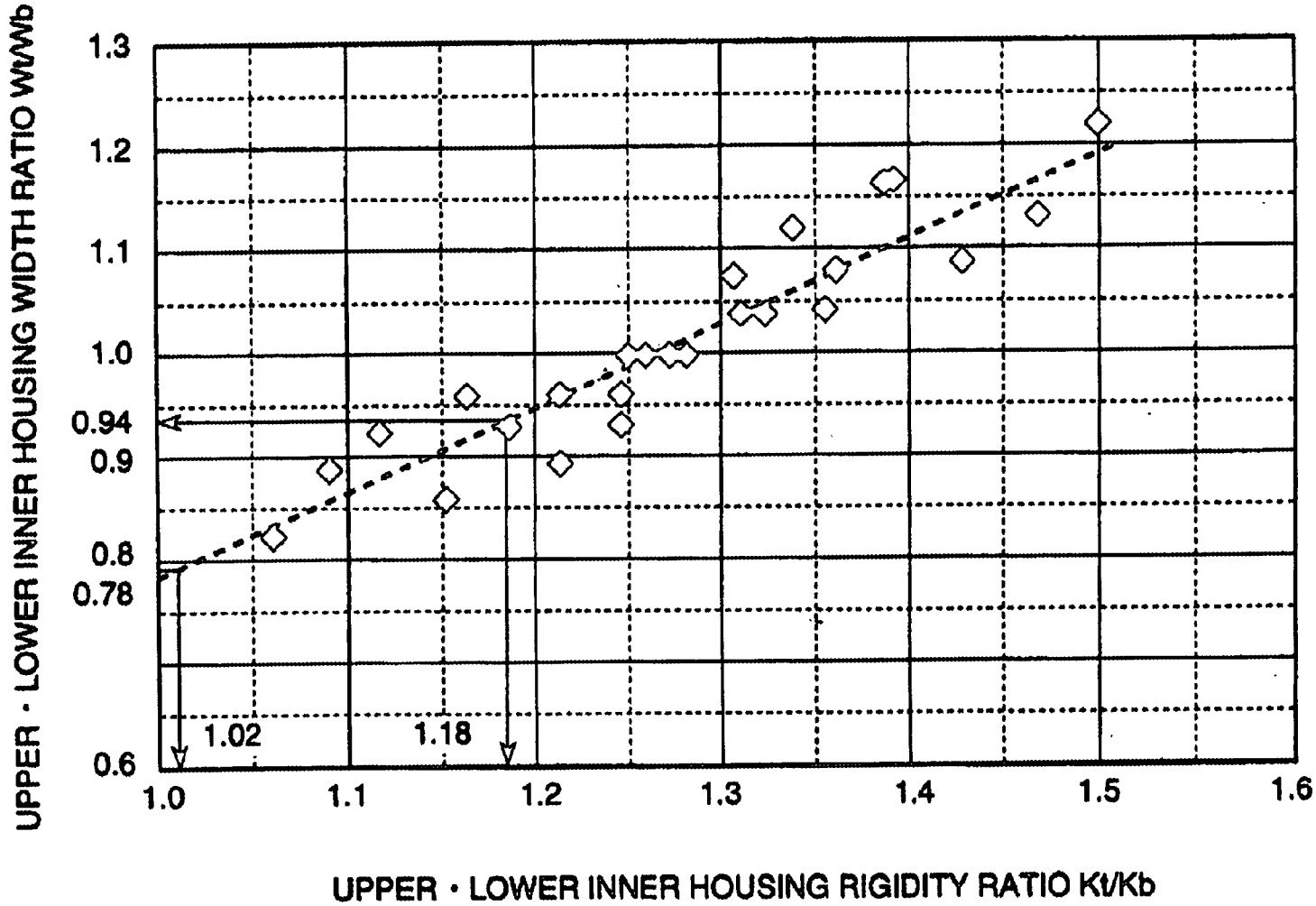
FIG. 15 is a graph showing the relationship between rigidity ratio of the top and the bottom inner housings and width ratio of the top and the bottom inner housings.

FIG. 15 is a graph in which the rigidity ratio of the top and the bottom inner housings is taken in the abscissa and the width ratio is taken in the ordinate, in the case where the upper side of the top inner housing is supported to the operating side and the driving side outer housings each at two point, and the press-down cylinders for adding the rolling load are arranged in the operating side and the driving side, as in the third embodiment. The heights of the top and the bottom inner housings are equal to each other, that is, ht=hb. The calculation is based on the same method as the calculation of FIG. 12.

It is clear from FIG. 15 that the rigidity ratio Kt/Kb of the top and the bottom inner housings can be set to a value within the range of 1.02 to 1.18 by setting the width ratio Wt/Wb of the top and bottom inner housings to a value within the range of 0.78 to 0.94, and accordingly an optimum housing proportion within a limited mill installation room can be determined.

In the above-mentioned embodiments, the top side supporting means for supporting the upper side of the top inner housing to the outer housing is formed of the rocker plate of the pass line adjusting mechanism, and the bottom side supporting means for supporting the lower side of the bottom inner housing to the outer housing is formed of the rocker plate of the press-down cylinder. However, on the contrary, the top side supporting means may be formed of the rocker plate of the press-down cylinder and the bottom side supporting means may be formed of the rocker plate of the pass line adjusting mechanism. In this case, the same effect can be obtained.

Further, although the above embodiments are described in regard to the 20-stage rolling mill, the same effect can be attained by applying the present invention to a 12-stage rolling mill.

According to the present invention, in a split housing type multistage rolling mill, stable rolling having good plate control capability can be performed by suppressing reduction of the mill rigidity as small as possible.

What is claimed is:

1. A cluster type multistage rolling mill comprising:

an upper group of rolls arranged above a pass line;

a lower group of rolls arranged below the pass line;

a top inner housing for containing said upper group of rolls;

a bottom inner housing for containing said lower group of rolls;

an operating side outer housing and a driving side outer housing, said outer housings being arranged at a distance from one another and containing said top and bottom inner housings;

a top side supporting means for supporting an upper side of said top inner housing to said outer housings in the operating side and the driving side each at two points in a front side and in a back side with respect to a pass direction, said top side supporting means being arranged in the upper side of said top inner housing and between said operating side and said driving side outer housings; and a bottom side supporting means for supporting a lower side of said bottom inner housing to said outer housings in the operating side and the driving side each at one point in the middle with respect to the pass direction, said bottom side supporting means being arranged in the lower side of said bottom inner housing and between said operating side and said driving side outer housings; and wherein a height of said bottom inner housing that is a distance between the uppermost portion thereof and a bottom portion thereof on which said bottom side supporting means is disposed is greater than a height of said top inner housing that is a distance between upper portions thereof on which said top side supporting means are disposed and the lowermost portion thereof so that a ratio of a vertical rigidity of said top inner housing to a vertical rigidity of said bottom inner housing is a value within a range of 1.02 to 1.18.

2. A cluster type multistage rolling mill comprising:

an upper group of rolls arranged above a pass line;

a lower group of rolls arranged below the pass line;

a top inner housing for containing said upper group of rolls;

a bottom inner housing for containing said lower group of rolls;

an operating side outer housing and a driving side outer housing, said outer housing being arranged at a distance from one another and containing said top and bottom inner housings;

a top side supporting means for supporting an upper side of said top inner housing to said outer housings in the operating side and the driving side each at two points in a front side and in a back side with respect to a pass direction, said top side supporting means being arranged in the upper side of said top inner housing and between said operating side and said driving side outer housings; and a bottom side supporting means for supporting a lower side of said bottom inner housing to said outer housings in the operating side and the driving side each at one point in the middle with respect to the pass direction, said bottom side supporting means being arranged in the lower side of said bottom inner housing and between said operating side and said driving side outer housings; and wherein the height of said bottom inner housing that is a distance between an uppermost portion thereof and a bottom portion thereof on which said bottom side supporting means is disposed is greater than the height of said top inner housing that is a distance between upper portions thereof on which said top side supporting means are disposed and the lowermost portion thereof.

3. A cluster type multistage rolling mill according to claim 2, wherein a height ratio of said top inner housing to said bottom inner housing is within a range of 0.72 to 0.98.

4. A cluster type multistage rolling mill comprising:

an upper group of rolls arranged above a pass line;

a lower group of rolls arranged below the pass line;

a top inner housing for containing said upper group of rolls;

a bottom inner housing for containing said lower group of rolls;

an operating side outer housing and a driving side outer housing, said outer housings being arranged at a distance from one another, and containing said top and bottom inner housings;

a top side supporting means for supporting an upper side of said top inner housing to said outer housings in the operating side and the driving side each at two points in a front side and in a back side with respect to a pass direction, said top side supporting means being arranged in the upper side of said top inner housing and between said operating side and said driving side outer housings; and a bottom side supporting means for supporting a lower side of said bottom inner housing to said outer housings in the operating side and the driving side each at one point in the middle with respect to the pass direction, said bottom side supporting means being arranged in the lower side of said bottom inner housing and between said operating side and said driving side outer housings; and wherein opposite sides of each of said top and bottom side inner housings, closely facing vertical lines of each of said operating and driving side outer housings, respectively, being substantially in parallel to each other, and the width in the pass direction of said bottom inner housing that is a distance between said opposite sides of said top inner housing is wider than the width in the pass direction of said top inner housing that is a distance between said opposite sides of said top inner housing.

5. A cluster type multistage rolling mill according to claim 4, wherein a width ratio of said top inner housing to said bottom inner housing is within a range of 0.78 to 0.94.

6. A cluster type multistage rolling mill according to claim 2, wherein the height of said bottom inner housing including a plate between the bottom of said bottom inner housing and said bottom side supporting means is a distance between the uppermost portion of said bottom inner housing and the bottom of said plate.

* * * * *